343-754 SR
8/23/77 OR 4,044,360

United States Patent [19]
Wolfson et al.
[11] 4,044,360
[45] Aug. 23, 1977

[54] TWO-MODE RF PHASE SHIFTER PARTICULARLY FOR PHASE SCANNER ARRAY

[75] Inventors: Ronald I. Wolfson, Northridge; Bobby J. Sanders, Pacoima, both of Calif.

[73] Assignee: International Telephone and Telegraph Corporation, New York, N.Y.

[21] Appl. No.: 642,297

[22] Filed: Dec. 19, 1975

[51] Int. Cl.[2] ..... H01Q 19/00
[52] U.S. Cl. ..... 343/754; 343/778; 333/84 M
[58] Field of Search ..... 343/754, 755, 854, 778; 333/31 R, 84 M

[56] References Cited

U.S. PATENT DOCUMENTS

| | | | |
|---|---|---|---|
| 3,259,902 | 7/1966 | Malech | 343/754 |
| 3,276,023 | 9/1966 | Dorne et al. | 343/754 |
| 3,430,242 | 2/1969 | Safran | 343/754 |

*Primary Examiner*—Eli Lieberman
*Attorney, Agent, or Firm*—William T. O'Neil

[57] ABSTRACT

A space-fed phased-array arrangement in which the plural antenna elements each include first and second (front and rear) individual radiators. Between these input and output radiators, there is a combined controllable phase shifter and controllable electronic switching arrangement. In accordance with external control signals, the amount of phase shift (phase delay) introduced by each element may be controlled, and by appropriate programming of these phase shifts, beam formation and pointing angle may be determined. The electronic switch devices are programmable to convert any or all of the antenna elements to reflector or retro-directing elements whereby a rear-pointing beam may be generated and scanned in substantially the same way as the forward beam is generated and scanned. In the retro-directive (reflective) mode, energy from the primary feed passes bi-directionally through the reciprocal controllable phase shifter sections.

12 Claims, 6 Drawing Figures

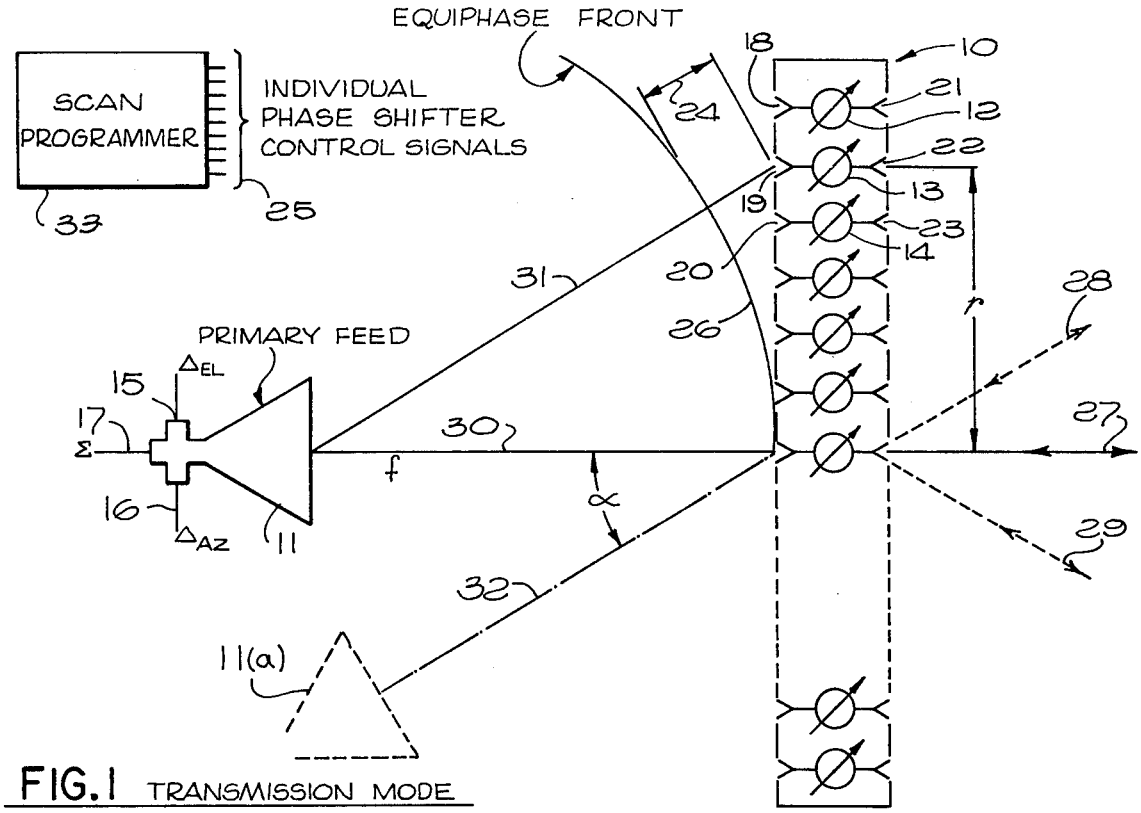
FIG. 1 TRANSMISSION MODE
PRIOR ART
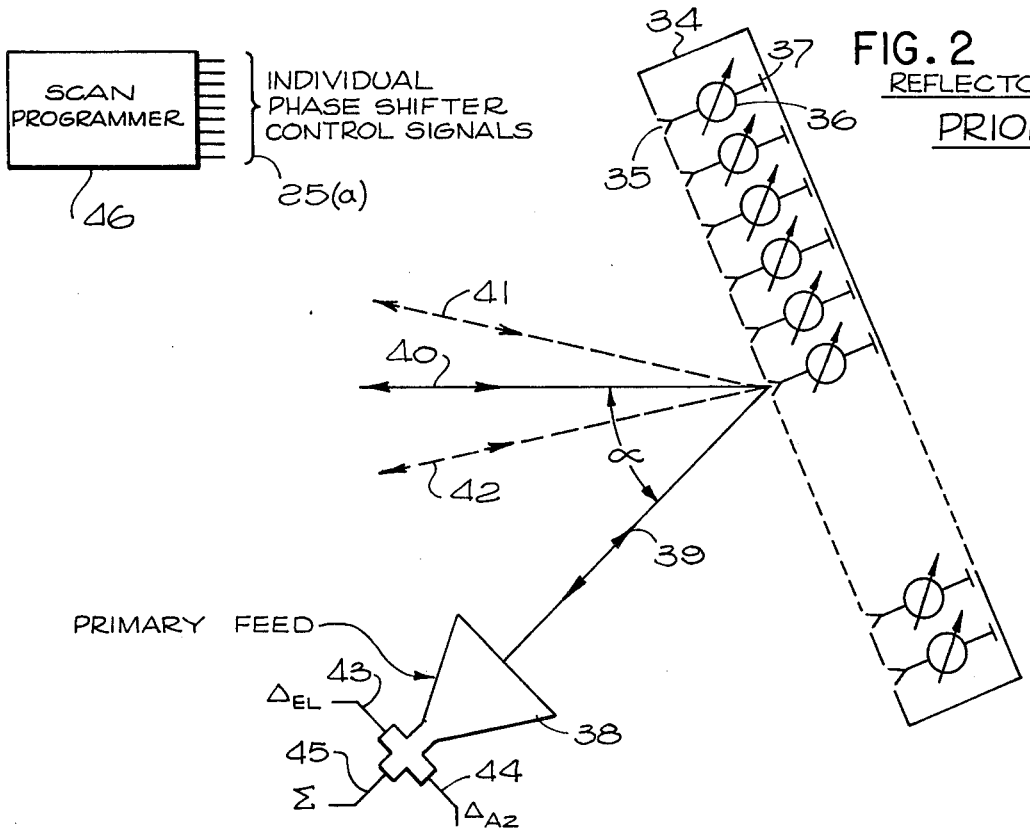
FIG. 2
REFLECTOR MODE
PRIOR ART.

TWO-MODE RF PHASE SHIFTER PARTICULARLY FOR PHASE SCANNER ARRAY

BACKGROUND OF THE INVENTION

1. Field of the Invention

The invention relates to scanning antennas in general and particularly to space-fed phased arrays.

2. Description of the Prior Art

Since the original development of techniques for inertialess scanning, there has been steady development in antenna systems providing the rapid scanning and random beam pointing basically made possible thereby. The various types of so-called phased-arrays usually contemplate a two-dimensional planar or curved surface arrangement of antenna elements (radiators) arranged to be fed and phased-controlled individually or in groups to form a beam in space and control its pointing angle on an instantaneous basis.

Chapter 11, entitled "Array Antennas" in the textbook entitled, "Radar Handbook" by Merrill I. Skolnik (McGraw-Hill 1970) is a useful and relatively current reference for obtaining an understanding of the state of the prior art in phased-array systems.

Of particular interest as prior art for the present invention, is Section 11.7 of that reference, which discusses optical (space) feed systems.

The various arrangements for feeding the elements of the phased-array have advantages and disadvantages, an the selection of a type of feed to be used in a system designed consideration. The so-called space or optical feed, phased-array system is the one to which the present invention applies. That type of feed employs a primary source of feed which may be in the form of a horn, or the like, arranged to illuminate the "back" of a panel or surface of the array which may be referred to as the rear aperture thereof. There is an intervening space between the primary feed and the array in such configurations, hence, the term space feed.

In such arrangements, the array itself may be thought of as a lens. Each of the radiators or antenna elements is essentially a feed through device which intercepts a portion of the primary feed illumination, subjects it to a controlled amount of phase delay and re-radiates it through the front aperture surface of the array. Programming the individually controllable phase shifters within the plural antenna elements thereby provides the desired beam pointing.

One particular advantage assignable to space-fed arrays is the relatively simple nature of the feed. The horn or other primary feed device may be readily designed to distribute the radiatable power uniformly over the rear array aperture or to provide whatever aperture tapering is desired, for sidelobe control or other purposes. To accomplish the same distributed feed by means of corporate feed techniques requires substantial additional hardware, a fact recognized by those skilled in this art.

The aforementioned "Radar Handbook" reference teaches that the space-fed phased array may be constructed to function in the refractive (transmission) lens mode or alternatively it may be constructed so that the individual antenna elements operate in a reflective mode so that the array is essentially a reflecting surface capable of individually controlling phases over its surface. In either case, controllable phase shifters are capable of providing the beam pointing function. The individual antenna elements may be thought of as refractive cells, and as such each is a 2-port device having a rear radiator, a phase shifter and a front radiator.

In the known prior art reflective mode, the antenna elements are individual refractive 1-port devices including a radiator and a phase shifter followed by a short or open circuit arrangement (depending upon the specific microwave parameters) to provide a reflecting point such that energy intercepted by the radiator passes through the phase shifter on the way to the reflective point and also on the way back. Such a reflective mode arrangement obviously requires the use of a reciprocal type phase shifter. In a transmission-type phased-array antenna of the type above mentioned it is often highly desirable to be able to provide some rearward detection capability. Some prior art approaches for dealing with that problem, involve such expedients as replacing some of the phased shifter elements with passive reflecting shorts. Such a scheme has severe limitations in that the rearward beam cannot be steered, its shape is not subject to programming, the gain in radiated power of the rearward beam are necessarily minimal. Still further, the ratio of forward-to-rearward radiated power cannot be electronically controlled.

Quite obviously, a fully operative and maximally flexible system can be provided by employing either two lens type (forward transmission) arrays with space feeds essentially back-to-back or with two reflective type arrays similarly back to back. In that way, fully programmed beam pointing can be afforded over substantial forward and rearward solid angles. However, the diseconomy of such an approach is obvious.

The matter in which the present invention deals with the prior art limitations aforementioned, by means of a novel combination will be understood as this description proceeds.

SUMMARY OF THE INVENTION

It may be said to have been the general objective of the present invention to provide a planar (or other surface shape) two-dimensional space-fed array including a plurality of individually phased-controllable radiators, with discrete phase control and mode-switching such that the predetermined number of radiators up to 100% may be operative for forward transmission, reception and scanning, and a second predetermined number of radiators up to 100% may be alternately independently operative to transmit, receive and scan to the rear. Where the front-acting and rear-acting elements are less than 100% of the total number of elements, they may be programmed to allow contemporaneously radiating, receiving and scanning in forward and rearward directions.

Each antenna element (radiator) comprises front and rear ports (lenses, horns, etc.), an intervening controllable phase shifter of a reciprocal type, and an electronically-operated selectively-employable reflective switch device. Accordingly, scanning and switching program can be employed as desired to control both the reflective switch and the phase shifters, those antenna elements programmed at any one time for forward radiation or reception have their phase shifters programmed to produce the desired forward beam pointing. Those antenna elements programmed for rearward transmission, reception and scan do not radiate substantially in the forward direction, the reflective switch being activated to redirect energy from the primary feed through the phase shifter and the rearward port.

The manner in which a typical embodiment according to the present invention is constructed and operated will be understood from the detailed description of a preferred embodiment hereinafter presented.

BRIEF DESCRIPTION OF THE DRAWINGS

FIG. 1 is a schematic block diagram illustrating the operation of a typical prior art space-fed planar array operative in the transmission (forward) mode.

FIG. 2 is a schematic block diagram illustrating the prior art typical reflector-mode space-fed planar array for rearward radiation and reception.

DESCRIPTION OF THE PREFERRED EMBODIMENT

Figure 3:
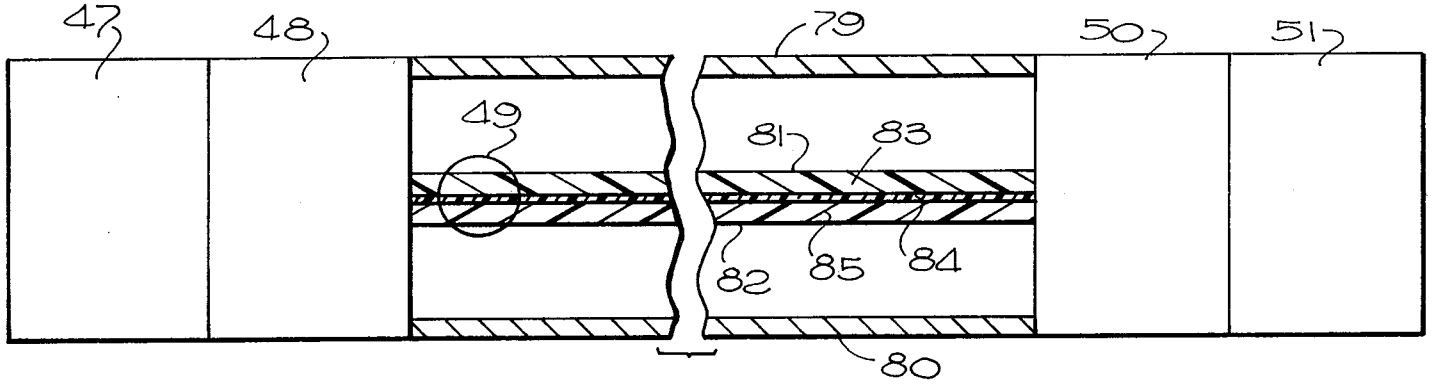
FIG. 3 is a partially sectioned block pictorial illustrating in overall form the assembly of a typical antenna element for use in the combination of the present invention.

FIGS. 1 and 2 are prior art per se, but are helpful in understanding the environment and utility of the present invention.

Referring now to FIG. 1, a side view (on edge) of a planar array 10 is depicted. The antenna elements, as that term is being used herein, comprise front and rear radiators, and interconnecting phase shifters, in a two dimensional pattern, forming a planar array along the front aperture. As illustrated, the array 10 is substantially a planar array, although neither the concepts of the prior art as depicted in FIGS. 1 and 2 nor the arrangement of the present invention are necessarily limited to planar arrays. Curved or cylindrical arrays may employ the same concepts.

The primary feed is illustrated as a horn 11 which may be a simple single-aperture horn, however, to show that both the prior art and the concepts of the present invention are consistent with such more elaborate systems such as monopulse, the horn 11 is illustrated as a four aperture of four horn arrangement typical of monopulse systems for tracking in two planes (azimuth and elevation for example). Thus the horn 11 has elevation and azimuth difference output ports 15 and 16, respectively, and a sum output port 17.

The horn 11 will be seen to illuminate the rear plane of the array 10 and the rear ports of the multiple antenna elements each intercept a portion of the energy provided by horn 11. In the top 3 elements as illustrated in FIG. 1, phase shifters 12, 13 and 14 are included corresponding to front plane ports or radiators 21, 22, and 23, respectively, and rear ports 18, 19 and 20, respectively. As a consideration of interest, although not directly related to the present invention, it will be noted that there is a path difference between the horn 11 and the individual antenna element rear ports in the array 10, depending upon their individual locations. The ray 30, represents the shortest path (also identified as $f$) between 10 and 11. Taking ray 31 arbitrarily, it will be noted that the distance, for example to rear antenna element port 19, is increased by an amount depicted at 24. If the term r is the offset from primary feed boresight 30, then the amount of this path lengthening along path 31 is equal to $(\sqrt{f^2 + r^2}) - f$. An equiphase front line 26 is shown, and in accordance with the known techniques in the phase/phase scanned planar arrays, phase shift applied by programmer 33 (having multiple individual control signals grouped at 25) can provide program modification to account for the aforementioned phenomenon as a modification of the individual phase values required for a predetermined scan or beam pointing program.

An alternate primary feed location is illustrated at 11($a$) providing a line of illumination 32 offset by an angle $\alpha$ from 30 as illustrated in FIG. 1. In accordance with the foregoing discussion, there will be a corresponding change in the location of the equiphase front 26 if the alternate position 11($a$) is taken for the primary feed, however, this too is compensable in the scan program developed in 33 providing individual element differential phase offsets distributed among the control lead group 25 in accordance with the path length variation from the equiphase front to the rear port of the corresponding elements. It will also be realized at this point that either horn 11 or 11($a$) can provide the transmitting illumination, the other operating to receive, if desired.

On FIG. 1, the boresight beam position of the array 10 is represented (in elevation for example) by ray 27, and alternate up and down pointing beam positions 28 and 29, respectively are depicted.

Referring now to FIG. 2, a planar array 34 operating in the reflective mode is illustrated. Here, the phase shifters, typically 36, are programmed by a corresponding signal within the scan control singal group 25($a$) generated by scan programmer 46.

In the configuration of FIG. 2, the aperture of the planar array is along the rear plane, hence, the rear ports such as 35, also serve as the transmission radiators, or ports, in addition to receiving the illumination provided by primary feed 38. An RF short circuit within each of these antenna elements (reflective short) typically 37, redirects energy passing into the radiators back through the corresponding phase shifter a second time and either out along beam pointing rays 40, 41 or 42, as programmed, or back along ray 39 to the primary feed 38 in the receiving mode, in this arrangement, the scan programmer 46 can also make the necessary path length corrections resulting from the hereinbefore discussed problem of unequal illumination path lengths between primary feed 38 and the antenna elements of array 34. Primary feed 38 would normally be offset as illustrated in FIG. 2 since in this reflector mode of operation there is an aperture blockage problem if the primary feed were located in accordance with the position of horn 11 in FIG. 1. Primary feed 38 is also illustrated as a two-coordinate monopulse horn having the elevation and azimuth difference ports 43 and 44, respectively, and sum port 45.

With an understanding of the two basic configurations of space-fed phased arrays, the present invention may now be described. Since the apparatus of the present invention involves both transmission and reflective modes of operation in the same array, the front ports or radiators serve as described in connection with FIG. 1 and the rear ports or radiators serve essentially as described in connection with FIG. 2. The feed arrangement such as depicted at 11($a$) of FIG. 1 is most desirable when antenna elements according to the present invention are employed, since both forward and rearward transmission are involved and therefore aperture blockage is a consideration.

Figure 4:
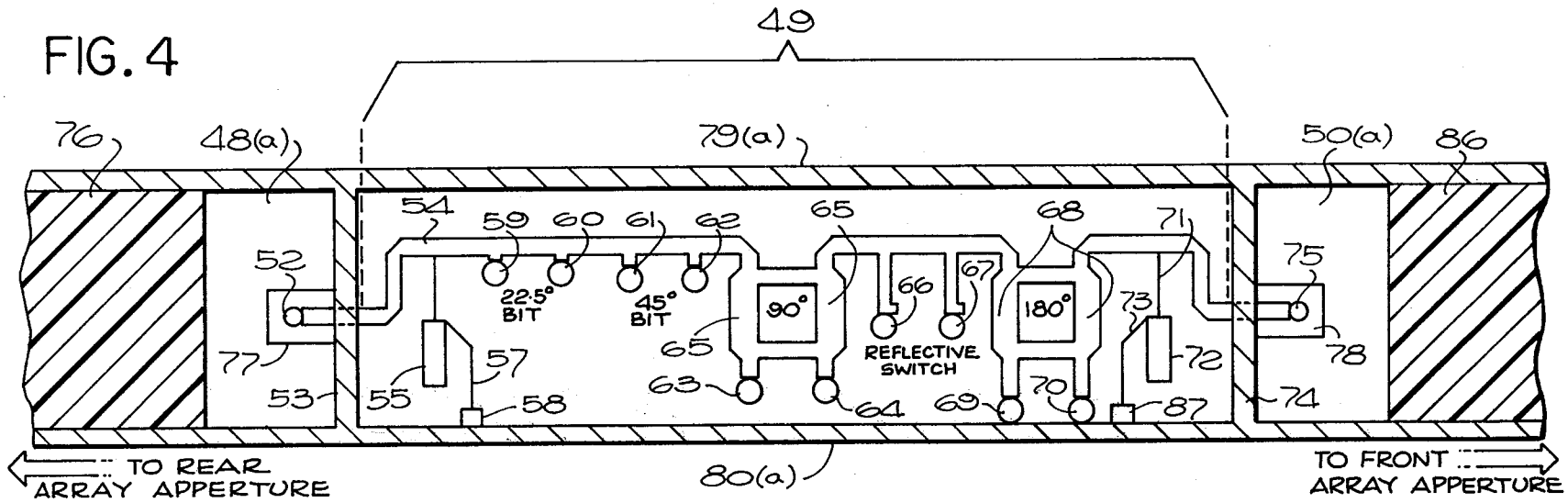
FIG. 4 illustrates a typical stripline phase shifter with integral reflective switch for use in connection with the present invention.

FIG. 3 is a partially sectioned pictorial showing the general configuration of what has been herein referred to as an antenna element, for use in an array such as depicted in FIG. 1 in order to implement the present invention. FIG. 4 is a more detailed view of the phase shifter and reflective switch stripline arrangement taken in accordance with a top view of the device of FIG. 3, the housing member 79, the top shield 81 and insulation 83 of the stripline 49 being removed to show typical internal construction for the stripline.

Basically, FIG. 3 shows an antenna element as that term has been used in this description. As such, it would replace input and output ports or radiators and the controllable phase shifter elements of FIG. 1. That is, typically for example, 18, 12 and 21, respectively. In FIG. 3, blocks 47 and 51 represent the rear and forward ports of the antenna element, respectively, and are not greatly different from the input and output port elements one would except to use in connection with a prior art device constructed in accordance with FIG. 1. The forward port or radiating element 51 would normally be a relatively wide angle radiator, this being appropriate for the development of a beam and the pointing thereof in accordance with the vector additions occurring at the forward aperture of the planar array. Element 47 may be comparable to 51 in those respects if a relatively wide angle of scan or beam pointing is to be effected by the rearward beam. Otherwise, 47 may be a somewhat more directive device, however, in either case these elements 47 and 51 might be microwave horns themselves, individual dielectric lenses compouned according to known techniques, or even individual dipoles or slot radiators. In any event, these elements 47 and 51 may be generically regarded as RF windows, it being understood that their nature is as hereinbefore described.

The elements 48 and 50 are transitions or interface devices. From the RF windows at either end of the element assembly of FIG. 3 it is assumed that the RF energy is conducted by a short section of waveguide transmission line, although the invention does not specifically require this, it being possible to implement the antenna element with sections of coaxial or other transmission line devices at these locations. Assuming however that waveguide format is used, it is generally avantageous to keep the lateral dimensions of the assembly of FIG. 3 to a minimum, since planar phased-array designs frequently require close radiator element spacings. Therefore, the waveguide sections within 48 and 50 contain, and for that matter, the throat of the windows 47 an 51 (especially if these are of the horn type) may also contain dielectric loading material as shown in FIG. 4 at 76 and 86.

The walls of the waveguide may conveniently be extended at 79 and 80 to provide a housing to contain the stripline device which embodies the controllable reciprocal phase shifter and the controllable reflective switch. The said stripline 49 will be seen to comprise upper and lower shields 81 and 82 and center stripline assembly 84, held between the two shields 81 and 82 by dielectric materials 83 and 85.

Referring now to FIG. 4, it will be noted that within the waveguide sidewalls 79(*a*) and 80(*a*), which are actually sidewalls perpendicular to 79 and 80 of FIG. 3, the stripline assembly 49 is contained axially within two separator walls 53 and 74. These conductive bulkheads create chambers 48(*a*) and 50(*a*) which, together with the probes 52 and 75 and corresponding matching dielectric blocks 77 and 78, respectively, comprise the transitions 48 and 50. The probes 52 and 75 are coupling stubs which pass through the conductive bulk heads 53 and 74 insulated therefrom. In fact the passage through these conductive bulkheads may be a very small section of coaxial transmission line. Thus blocks 48 and 50 may be thought of as transitions between microstrip and waveguide transmission line formats. The bulkheads 53 and 74 serve as waveguide shorts and are arranged to set the proper impedence at the probes or waveguide posts 52 and 75, respectively.

Construction of the entire device in 50ohm characteristic impedence achieves low insertion loss consistent with good power handling characteristics.

Considering now the phase shifter and reflective switch assembly, it will be seen that these are integral within the assembly 49.

The phase shifter, although it may be an analog device alternatively, is illustrated as a 4-bit digitally controlled device. The bit significances are 22½°, 45°, 90° and 180°. The 22½° bit is produced by bringing RF diodes 59 and 60 into conduction, the circuit for superimposing the RF and dc control paths in operating these (preferably P.I.N.) diodes will be described hereinafter, however, for the moment is sufficient to note that conduction of diodes 59 and 60 provides an RF short circuit path from the points indicated to the lower shield 82. The stripline itself, typically at 54, is an etched conductor applied by printed circuit techniques on an insulating carrier strip, this combination being the layer illustrated at 84 in FIG. 3.

It will be noted that the 90 and 180 degree phase shifters comprising the arm 65 and 68, respectively, form etched circuit hybrids, this being a more satisfactory arrangement than presented for the less significant bits, since the arms or stubs leading laterally from the main stripline to connect to the various diodes are preferably held to relatively short lengths to reduce frequency sensitivities. The reflective switch includes the RF diodes 66 and 67 (preferably also of the P.I.N. type) mounted as indicated on quarterwave stubs from the main conductive strip.

The two phase bits of lesser significance (22.5° and 45° ) are achieved by using loaded-line techniques rather than the hybrid-coupled techniques used for the 90° an 180° bits. To achieve the desired phase shifts, the loaded-line phase bits are produced by the shunt mounted conducting diodes, for example, 59 and 60 for the 22½° bit and 61 and 62 for the 45° bit. These are mounted essentially at the end of a lateral stub extending from the main stripline conductor as illustrated. These stubs are spaced along the axial dimension of the transmission line such that their reflections are mutually cancelling, the axial spacing between the two stubs being on the order of one-quarter wavelength. The amount of phase shift in each case is a function of the length of the stub, and it will be seen that these stubs are of different lengths for the 45° bit, vis-a-vis the 22½° bit. Those skilled in this art can readily determine the appropriate stub length for these or any other bit significances as may be chosen. The 22½°, 45°, 90°and 180° bit significances are of course arbitrary, and selected mainly for illustration.

For the hybrid-coupled phase bits, the phase shifing is achieved by using a 3dB hybrid junction with balanced phase stubs connected to the coupled arms. These hybrids are represented at 65 for the 90° bit and 68 for the 180° phase bit, whereas diode 63 and 64, 69 and 70 comprise the pairs of diodes, respectively, applicable to those hybrids, as illustrated. The configuration of the hybrid arrangement will also be recognized by those skilled in this art and the criteria for their specific designs are well known.

It will be noted at this point that the reflective switch comprising the diodes 66 and 67 mounted on quarter-wave stubs laterally from the main transmission line conductor and spaced axially by an additional quarter-wave length are placed between the 90° and 180° hybrids as hereinbefore explained. The reflective switch essentially reverses the energy travelling through the stripline (i.e. from left to right as depicted of FIG. 4) and redirects it back to the rear array aperture (i.e. from right to left), when the said switch is activated to generate this reflection point (i.e. when the diodes 69 and 70 are reverse biased). It will be realized, that the use of a 180° phase shifter bi-directionally produces a 360° or net zero phase shift, consequently the 180° phase shifter is located "downstream" of the reflective switch and therefore is only useful in the transmissive mode, i.e. when the reflective switch is not activated.

It will be realized, of course, that in the design involving different values of phase shift, and especially a different value of the most significant phase bit, it is entirely possible to locate that shifter ahead of ("upstream" from) the reflective switch. The reflective switch which is also a shunt connected arrangement, is inherently a high Q device affording minimum insertion loss in one state and maximum isolation in the other.

It will be realized that in the transmission mode, the phase shifter has a 4-bit, 16 phase-state capability, whereas in the reflective mode it has a 3-bit, 8 phase-state capability. This is because a binomial scheme is frequently used to select the individual phase bit significances, that is the largest bit is 360°/2 or 180°. The next largest is $360°/2^2$ or 90° and so on to the $n$th bit, $360°/2^n$. This scheme provides $2^n$ phase states in the transmission mode, and increments of the smallest bit. In the reflection mode, the size of the increment is doubled because of the two-way trip through the phase bits, hence, in effect the smallest bit is lost and only $2^{n-1}$ states can be realized. As previously indicated, the 180° bit serves no useful purpose in the reflective mode and this explains its placement after the reflective switch to minimize the reflective-mode insertion loss.

A still more detailed understanding of the operation of the present typical phase shifter and reflective switch arrangement may be obtained from Table 1. In Table 1, a one in the column of each bit significance applies the corresponding phase shift amount and a zero passes the energy without phase shift. Total phase shift obtainable is given for both transmission and reflection modes.

TABLE I

| BIT | | | | TOTAL PHASE SHIFT (°) | |
|---|---|---|---|---|---|
| 180° | 90° | 45° | 22.5° | Transmission Mode | Reflection Mode |
| 0 | 0 | 0 | 0 | 0 | 0 |
| 0 | 0 | 0 | 1 | 22.5 | 45 |
| 0 | 0 | 1 | 0 | 45 | 90 |
| 0 | 0 | 1 | 1 | 67.5 | 135 |
| 0 | 1 | 0 | 0 | 90 | 180 |
| 0 | 1 | 0 | 1 | 112.5 | 225 |
| 0 | 1 | 1 | 0 | 135 | 270 |
| 0 | 1 | 1 | 1 | 157.5 | 315 |
| 1 | 0 | 0 | 0 | 180 | 0 |
| 1 | 0 | 0 | 1 | 202.5 | 45 |
| 1 | 0 | 1 | 0 | 225 | 90 |

TABLE I-continued

| BIT | | | | TOTAL PHASE SHIFT (°) | |
|---|---|---|---|---|---|
| 180° | 90° | 45° | 22.5° | Transmission Mode | Reflection Mode |
| 1 | 0 | 1 | 1 | 247.5 | 135 |
| 1 | 1 | 0 | 0 | 270 | 180 |
| 1 | 1 | 0 | 1 | 292.5 | 225 |
| 1 | 1 | 1 | 0 | 315 | 270 |
| 1 | 1 | 1 | 1 | 337.5 | 315 |

Each of the RF diodes employed in the phase shifter and reflective switch is RF and dc bonded to the individual stub as illustrated on FIG. 4 at one end. On the other end, a dc insulative RF bypassed point is generated where the "bottom" diode terminal passes through the lower stripline shield 82. Such an expedient is well known in this art and is sometimes referred to as a capacitive feed-through. In the most practical systems of the type employing the present invention, the radio frequencies are in the microwave region and therefor the bypass of the diode to the lower stripline shield, as aforementioned, can be accomplished with a very small amount of capacitance.

The various diodes of the phase shifter sections as well as the reflective switch diodes are all RF and dc bonded to the conductive etched circuitry in the view of FIG. 4, and accordingly, the control signal return path (dc return in this context) is effected through the etched conductors of the microstrip circuitry as seen FIG. 4. Two band-pass filter sections provide a high order of RF isolation at two points along the strip at either end of the phase shifter/switch assembly. By placing theses filters at both ends of the assembly the diode currents tend to balance, and additional blocking capacitors are not required. As shown of FIG. 4, the left band-pass filter comprises the high impedance connection 56, a shunt (effectively to ground) low impedance etched section 55, a high impedence connection 57 and a dc ground at 58 to provide a common return for the pin diodes. Similarly, at the right hand side of the stripline the same functions are provided by 71, 72, 73 and 87, respectively. Those of skill in the techniques of etched microcircuitry, especially as it relates to strip transmission lines, will recognize the structure of these band-pass filters and will be able to implement them dimensionally from the ordinary skill of those arts.

Figure 5:
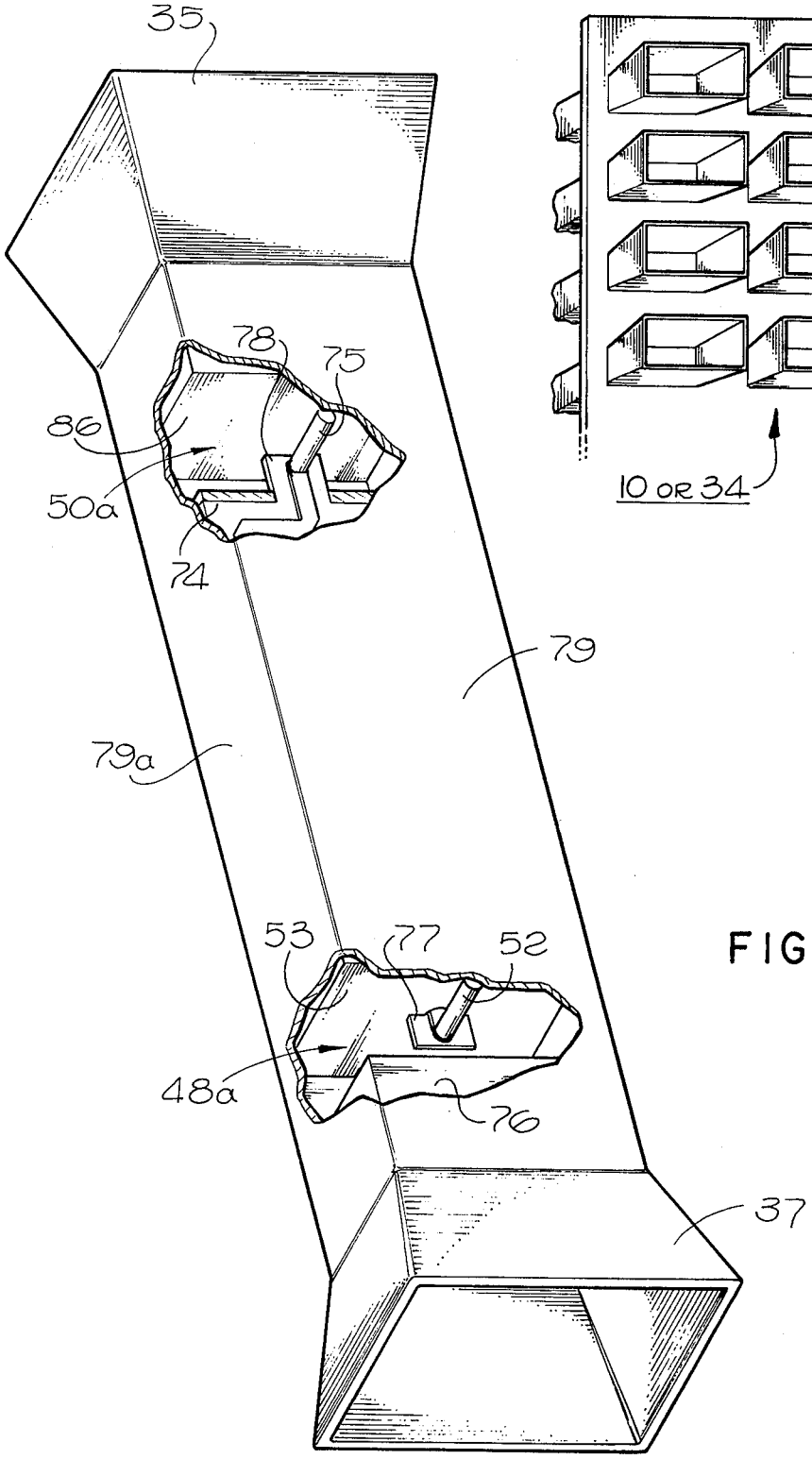
FIG. 5 is a partially cut-away pictorial of an antenna element according to FIGS. 3 and 4.

Referring now to FIG. 5, the antenna element of FIGS. 3 and 4 is shown in pictorial form with cutaways so that the relationships of the probes 52 and 75 and other elements already identified in FIGS. 3 and 4 are consistently identified and will be readily understood. The actual radiatiors 35 and 37 are depicted as horns and are arbitrarily identified consistently with FIG. 2. Although FIG. 2 assumes a horn element at 35 and a dipole element at 37, the description hereinbefore makes it clear that there is design choice in respect to the type of radiators employed within the concepts of the invention.

Figure 6:
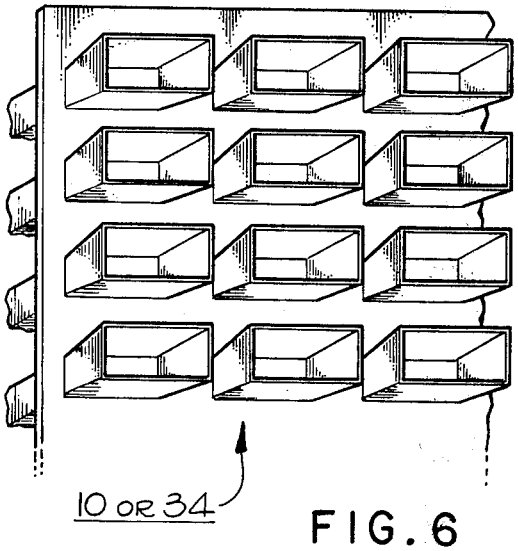
FIG. 6 is a pictorial of a part of an array according to the invention viewed from either aperture.

FIG. 6 shows a portion of an array such as 10 or 34 having a plurality of elements such as illustrated in FIG. 5. The view of FIG. 6 could be considered to be either side of the array.

Modifications and variations in the structure and circuits of the device as described will suggest themselves to those skilled in this art, once the principles of the present invention are understood. Accordingly, it is not intended that the drawing or this description should be considered as limiting the scope of the invention, these being regard as typical and illustrative only.

What is claimed is:

1. In a scanning antenna system including a plurality of antenna elements arranged in a two-dimensional array having first and second back-to-back apertures surfaces and having space feed means arranged for illuminating said first aperture surface, the combination comprising:

means within each element of a predetermined fraction of said elements comprising a first RF window within said first aperture of said array and a second RF window within said second aperture of said array;

phase shift means within each of said elements of said predetermined fraction of elements coupled betwen said windows of each corresponding element, for controlling the RF phase through each element in response to a corresponding condition of a discrete externally supplied phase control signal for each of said elements so controlled;

and switching means within at least a second fraction of said predetermined fraction of said elements for selectively permitting passage of RF energy from said space feed through said first window, said phase shift means and said second RF window in a first switching condition, and bidirectionally through said first window and said phase shift means in a second switching condition, said switching means providing a reflection point within said antenna element in said second switching condition.

2. Apparatus according to claim 1 in which said predetermined fraction of said elements being constructed to include said first and second RF windows and said phase shift means is substantially all of said plurality of antenna elements.

3. Apparatus according to claim 1 in whih said second fraction of said predetermined and of said antenna elements is defined as being substantially all of said elements of said predetermined fraction.

4. Apparatus according to claim 2 in which said second fraction of said predetermined fraction of said antenna elements is defined as being substantially all of said elements of said predetermined fraction.

5. Apparatus according to claim 1 in which said phase shift means is defined as being a type which is reciprocal.

6. Apparatus according to claim 5 in which said phase shift means comprises a stripline phase shifter within each element of said predetermined fraction of antenna elements and diode phase delay control means are included comprising at least one phase delay control diode located in said stripline and connected to have no substantial effect on the phase delay provided by said stripline when said condition of said externally supplied phase control signal is such as to render said diode RF non-conducting, said diode being arranged to provide a predetermined change of said phase delay corresponding to a second condition of said control signal.

7. Apparatus according to claim 6 in which said switching means is further defined as including at least one switching diode responsive to an externally generated switching control signal to provide said reflection point corresponding to a second condition of said switching control signal, the first condition of said switching control signal being such as to cause said switching diode to be substantially inoperative and therefore to permit passage of said RF energy between said first and second RF windows.

8. Apparatus according to claim 7 in which said phase delay control diode and said switching diode are arranged to be back-biased during said phase and switching control signal first conditions, respectively, and to be forward biased sufficiently to permit a predetermined substantial amount of RF conduction in said phase and switching control signal second conditions, respectively.

9. Apparatus according to claim 8 in which said phase control signal is defined as a digital signal and sai phase delay control means comprises a plurality of diodes each connected to have a phase delay effect relating to the significance of a bit of said digital signal, the bits of said digital signal each being applied to control the corresponding diode of said phase delay control means.

10. Apparatus according to claim 9 in which all of said antenna elements contain said phase shift and switching means, thereby to provide comparable control of beam pointing from both aperture surfaces of said array.

11. Apparatus according to claim 1 in which said two-dimensional array is substantially a planar array.

12. Apparatus according to claim 10 in which said first and second aperture surfaces of said array are planar and are substantially parallel.

* * * * *